US005732950A

United States Patent [19]

Moody

[11] Patent Number: 5,732,950

[45] Date of Patent: Mar. 31, 1998

[54] ELECTRONIC VIDEO POKER GAMES

[76] Inventor: Ernest W. Moody, 4381 Pebble Beach Dr., Niwot, Colo. 80503

[21] Appl. No.: 755,174

[22] Filed: Nov. 25, 1996

Related U.S. Application Data

[63] Continuation-in-part of Ser. No. 495,952, Jun. 28, 1995, Pat. No. 5,531,448, and a continuation-in-part of Ser. No. 19,879, Jun. 17, 1996.

[60] Provisional application No. 60/019,879 Jun. 17, 1996.

[51] Int. Cl.[6] ..... A63F 1/00

[52] U.S. Cl. ..... 273/292

[58] Field of Search ..... 273/292, 274, 273/303; 463/12, 13

[56] References Cited

U.S. PATENT DOCUMENTS 5,265,882 11/1993 Malek ..... 273/292
5,328,189 7/1994 Malek ..... 273/292
5,377,993 1/1995 Josephs ..... 463/13 X
5,496,038 3/1996 Kangsanaraks ..... 273/292
5,577,731 11/1996 Jones ..... 273/292
5,639,092 6/1997 Mocaisa ..... 273/292

*Primary Examiner*—William E. Stoll
*Attorney, Agent, or Firm*—John Edward Roethel

[57] ABSTRACT

The method of present invention involves dealing multiple rows of five card hands. The player attempts to achieve a high ranking poker hand on the center row by using face up and face down cards as potential replacement cards for the five cards initially dealt to the center row. An alternate method of the present invention involves permitting the player to play up to three hands of video poker at the same time. Another version of the present invention involves combining a Twenty-One game with a Stud Poker game in which the cards used during the play of the Twenty-One game are utilized to form a Stud Poker hand.

7 Claims, 13 Drawing Sheets

ELECTRONIC VIDEO POKER GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448, and is also a Continuation-in-Part of Provisional Application Ser. No. 60/019,879, entitled "Electronic Video Poker Games", filed Jun. 17, 1996, now abandoned.

BACKGROUND OF THE INVENTION

This invention relates primarily to electronic video poker games, and more particularly to electronic video poker games that are based on poker hand rankings and allow the player to discard and replace unwanted cards with replacement cards. The present invention has many versions with the common thread being that the player is shown possible replacement cards face up at the time the player must make his decision as to which cards to hold and which cards to discard. The invention also involves features which may apply to casino table games as well.

SUMMARY OF THE INVENTION

The method of present invention involves dealing multiple rows of five card hands. The player attempts to achieve a high ranking poker hand on the center row by using face up and face down cards as potential replacement cards for the five cards initially dealt to the center row. An alternate method of the present invention involves permitting the player to play up to three hands of video poker at the same time.

DETAILED DESCRIPTION OF THE PREFERRED EMBODIMENTS

The present invention includes a variety of electronic video poker games. Each electronic video poker game is designed to be played by having the hands displayed on a video screen to a player. By manipulating the buttons on the gaming device or by using conventional touch screen technology, the player selects which cards he wishes to play, which cards he wishes to move from one location to another on the screen display and which cards he wishes to discard. Replacement cards are then displayed for the discarded cards and the outcome of the play of the hand is determined.

Version #1—Super Poker I

Figure 1:
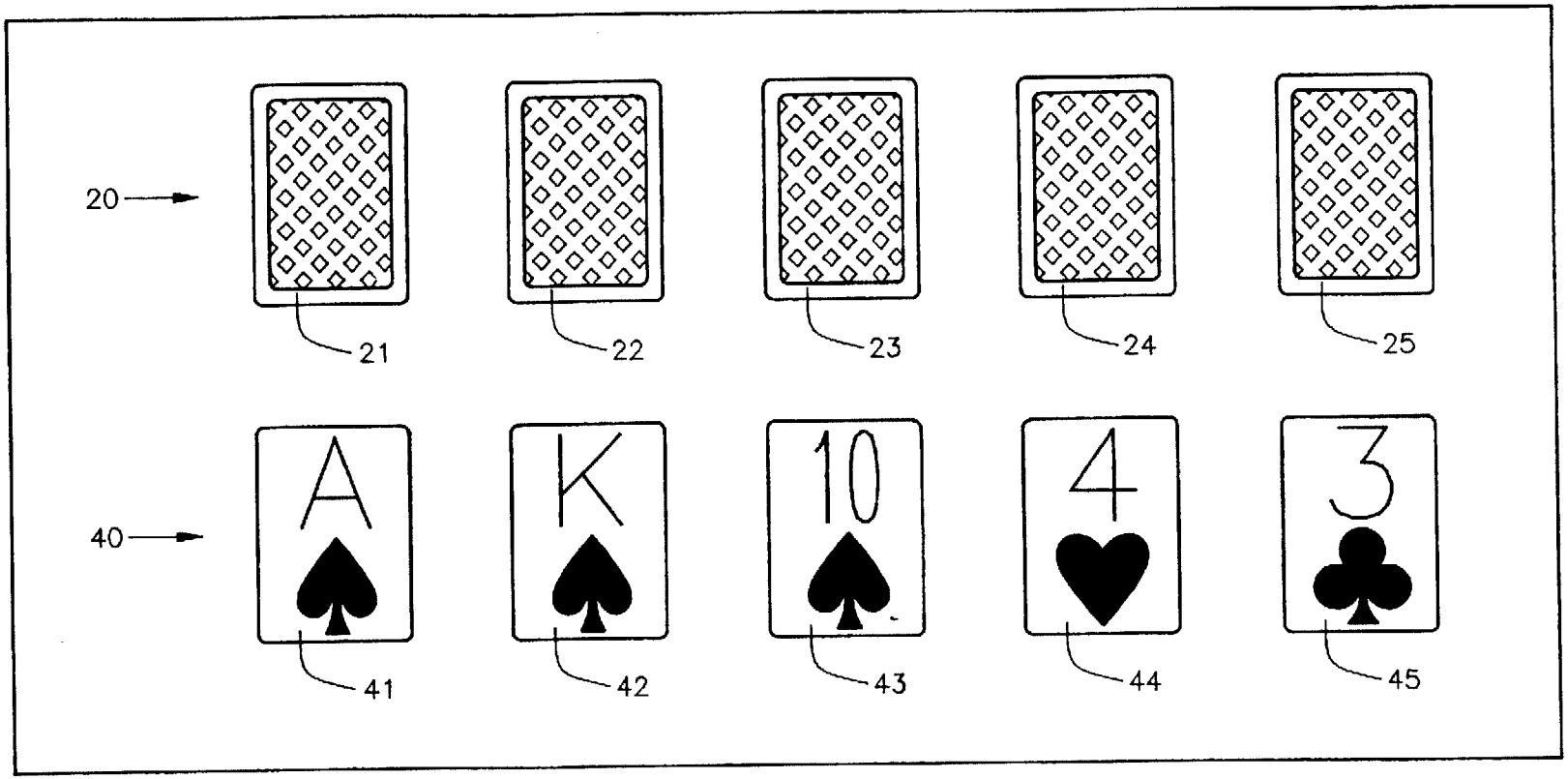
FIG. 1 shows the screen display for Version #1 of the present invention after the initial deal of the cards.

Version #1 of the invention is a poker-type game in which two horizontal rows of five cards each are displayed on a video screen. FIG. 1 shows the screen display for this game at the point in which the two initial five card hands are dealt and displayed to the player. A conventional deck of fifty-two cards is used. Two five card hands are dealt to the player. The first hand 20 is a five card stud poker hand dealt face down. The second hand 40 is a five card draw poker hand dealt face up. In the preferred embodiment of the present invention, the second hand 40 is aligned card-for-card over the first hand. In the preferred embodiment of the present invention, the player makes two wagers—one for the stud poker hand and one for the draw poker hand.

As an example, FIG. 1 shows the first hand 20 comprising five cards 21, 22, 23, 24 and 25 all displayed face down. The second hand 40 comprises five face up cards—the Ace of Spades 41, the King of Spades 42, the Ten of Spades 42, the Four of Hearts 44 and the Three of Clubs 45.

The player first plays the five card draw poker hand. The player selects which of the five cards he wishes to discard and replacement cards for the discarded cards come from the stud poker hand. In the preferred embodiment of the present invention, the replacement cards are selected by using the card from the first hand 20 that is vertically aligned with the discarded card from the second hand 40.

Again with reference to FIG. 1, the player would most likely discard the Four of Hearts 44 and the Three of Clubs 45 and attempt to draw into a Royal Flush in Spades. The cards that the player would receive as replacement cards for his discard are card 24 and card 25 from the first hand 20.

Electronically card 44 would be removed from the screen and card 24 would be reproduced at the screen location where card 44 formerly was. Likewise, card 45 would be removed from the screen display and card 25 would be reproduced at the screen location where card 45 formerly was.

Figure 2:
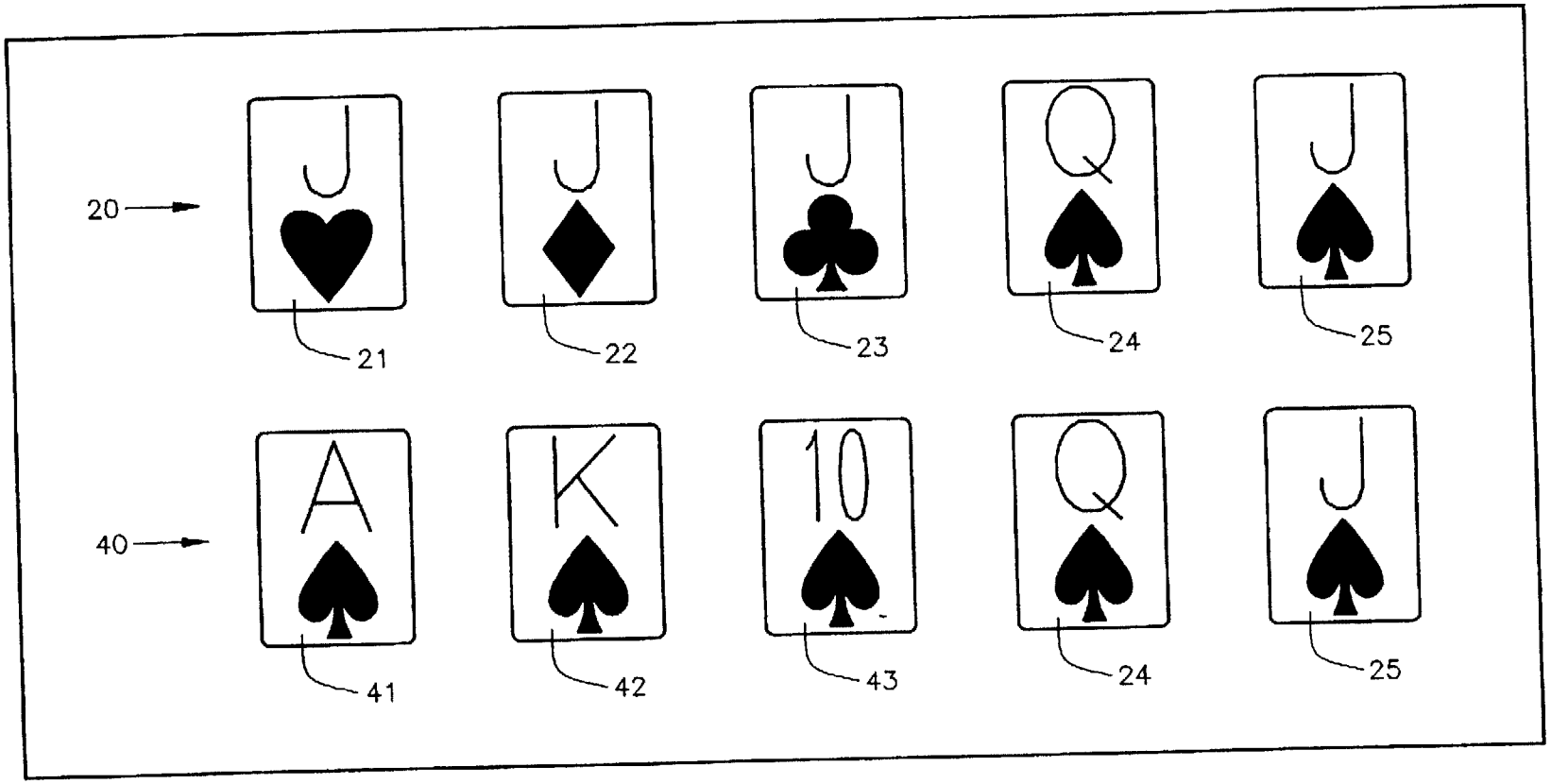
FIG. 2 shows the screen display for Version #1 and shows a result that could occur during the play of the game.

At same time that this is occurring, all five cards from the first hand 20 are turned face up and displayed to the player. This results in two five card hands being displayed to the player on the screen display as shown in FIG. 2. Any cards from the first hand 20 that are also used as replacement cards in the second hand 40 are therefore displayed twice on the screen display.

Following along with the example from FIG. 1, FIG. 2 shows results that could occur. Assuming the player discarded the Four of Hearts 44 from the second hand 40, the replacement card for card 44 is card 24 (since card 24 is vertically aligned with card 44 on the screen display) from the first hand 20 which turned out to be the Queen of Spades when card 24 is turned face up. Likewise, assuming the player discarded the Three of Clubs 45 from the second hand 40, the replacement card for card 45 is card 25 (since card 25 is vertically aligned with card 45 on the screen display) from the first hand 20 which turned out to be the Jack of Spades when card 25 is turned up.

Thus, the draw hand 40 resulted in a hand having a poker rank of a Royal Flush in Spades. Likewise, when the first hand 20 is turned face up, it resulted in a hand having a poker rank of Four Jacks. The Queen of Spades 24 and Jack of Spades 25 are used in both the first hand 20 and the second hand 40.

Payout schedules are provided for both the five card stud hand 20 and the five card draw hand 40 and a player is paid amounts based on the amount of his wager on each hand according the payout schedule which is based on poker hand rankings as in conventional video or electronic poker machines.

Suitable payout schedules are used for both the stud hand and the draw poker hand. The payouts can be fixed or flat jackpot amounts being multiples of the amount of the wager. Alternatively, progressive jackpot amounts can be provided for winning combinations. For example, a first progressive jackpot amount can be provided for achieving a Royal Flush in the stud poker hand 20 and a second progressive jackpot amount can be provided for achieving a Royal Flush in the draw poker hand 40.

Figure 3:
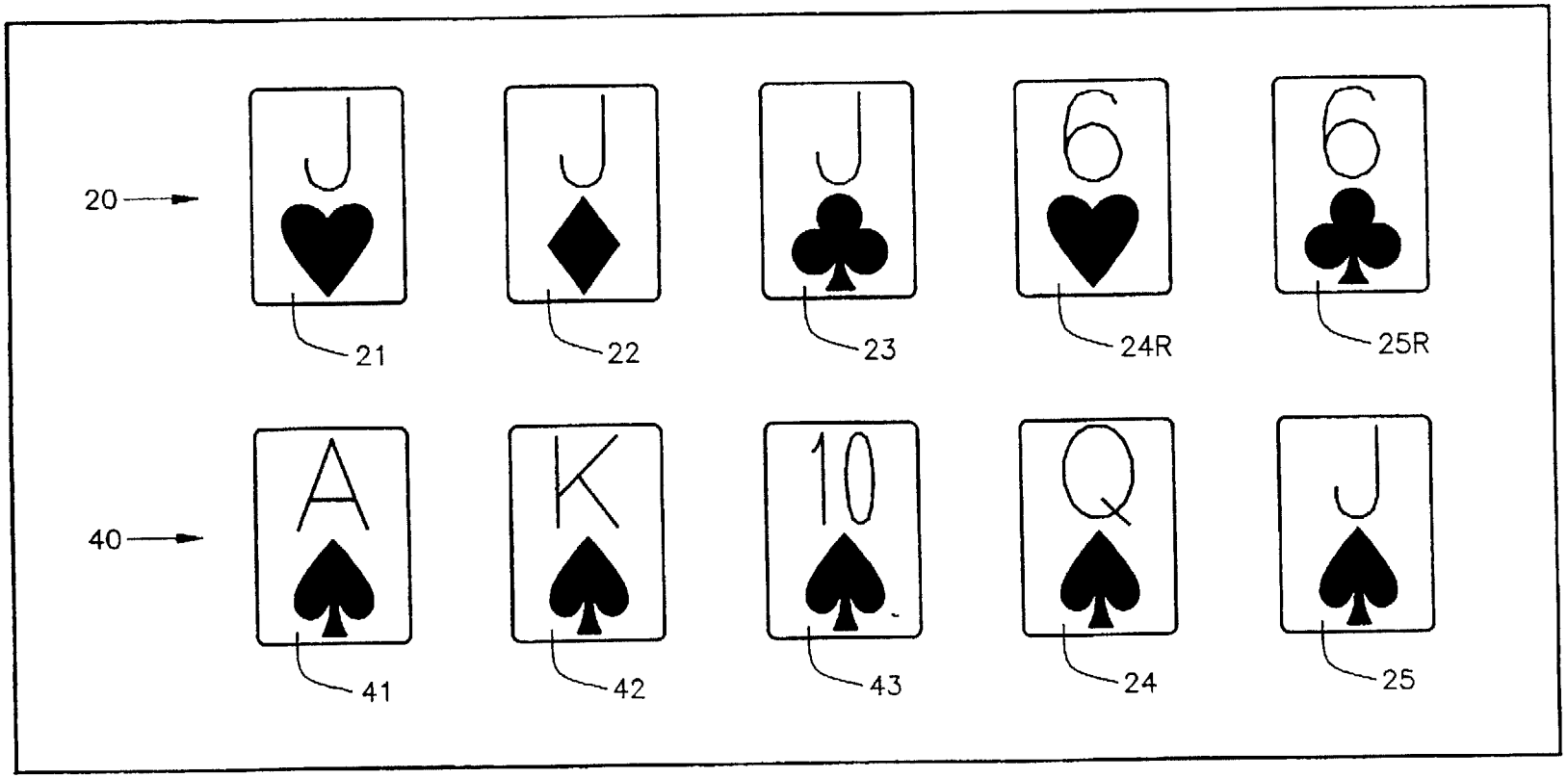
FIG. 3 shows a modification to the method of play of Version #1.

The above-described method of play can be modified in that any cards from the first hand 20 that are used as replacement cards in the second hand would themselves be replaced by new cards from the original deck of fifty-two cards. For example, FIG. 3 shows this modification. After discarding from the second hand 40, the Queen of Spades 24 and the Jack of Spades 25 are physically moved from the first hand 20 to their corresponding vertically aligned locations in the second hand 40. Replacement cards are dealt from the original fifty-two card deck resulting in the Six of Hearts 24R and the Six of Clubs 25R being added to the first hand 20. The resulting hands in this example are a Royal Flush in Spades in the draw poker hand 40 and a Full House in the stud poker hand 20.

This version may also be modified with the use of certain optional features. These features may apply as an option to standard five card video poker, as well. One optional feature is a "Double Down" feature in which the player may double the amount of his original wager if the player achieves certain cards on the initial deal. For example, if a player is dealt one pair in the draw poker hand 40, the player may exercise the option of doubling the amount of his initial wager.

Another optional feature is the "Split" feature. In this feature, the player has the option of splitting the face up cards of the draw hand 40 into two five card hands. This may be done according to rank or suit or any other strategy that the player may wish to employ. For example, if the initial draw hand 40 contains a pair of 6's and a pair of 7's, the player may elect to split these pairs into two separate draw hands. A first draw hand would contain the pair of 6's and the second draw hand would contain the pair of 7's. The initial fifth card would be discarded. The three replacement cards that are now needed to complete each draw hand come from the stud hand and would be the same three cards used in both the first draw hand and the second draw hand. An additional wager would be required for the additional draw hand.

Version #2—Super Poker II (Super Slot Poker)

Version #2 of the present invention is a poker-type card game in which three horizontal rows of cards are displayed to the player. This version has a number of variations which will be explained as follows:

Version #2A. This version of the present invention uses a standard fifty-two card deck. A player makes an initial wager to activate the game. After the wager is made, three horizontal rows of five cards each are displayed to the player on the screen display. The center row is displayed face up, the bottom row is displayed face up and the top row is displayed face down. (Alternatively, the top row is displayed face up and the bottom row is displayed face down, as the preferred embodiment is that two of the rows are face up and one of the rows is face down; it is most preferred that the center row be one of the face up rows as that makes the game easiest to play and understand for the player).

Figure 4:
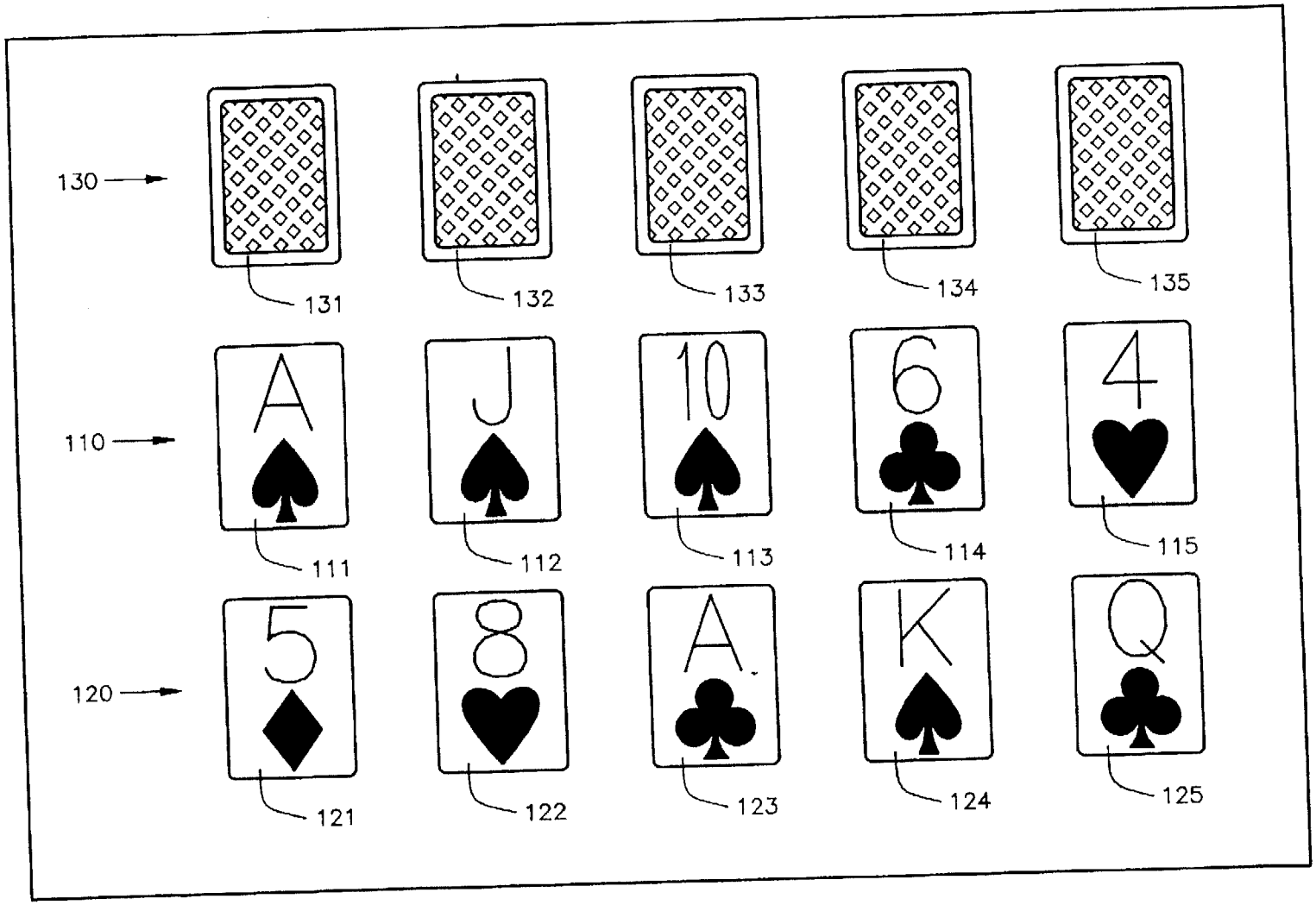
FIG. 4 shows the screen display for Version #2A of the present invention after the initial deal of the cards.

FIG. 4 shows an example of the cards displayed to the player on the initial deal. All fifteen cards are dealt from a single fifty-two card deck of standard playing cards.

The center row 110 is the draw hand to be played by the player and is displayed face up and in this example the player received as the draw hand 110 the Ace of Spades 111, the Jack of Spades 112, the Ten of Spades 113, the Six of Clubs 114 and the Four of Hearts 115. At the same time as the center row 110 is displayed to the player, the bottom row 120 is also displayed on the screen with all cards face up. The cards in the bottom row 120 are vertically aligned with the corresponding cards in the center row 110. In the example shown in FIG. 4, the cards in the bottom row 120 are the Five of Diamonds 121, the Eight of Hearts 122, the Ace of Clubs 123, the King of Spades 124 and the Queen of Clubs 125.

Also, at the same time that the center row 110 and the bottom row 120 cards are dealt, the top row 130 cards are dealt. Five cards 131, 132, 133, 134 and 135 are displayed on the video screen face down and are vertically aligned with the corresponding cards in the center row 110 and the bottom row 120.

Figure 5:
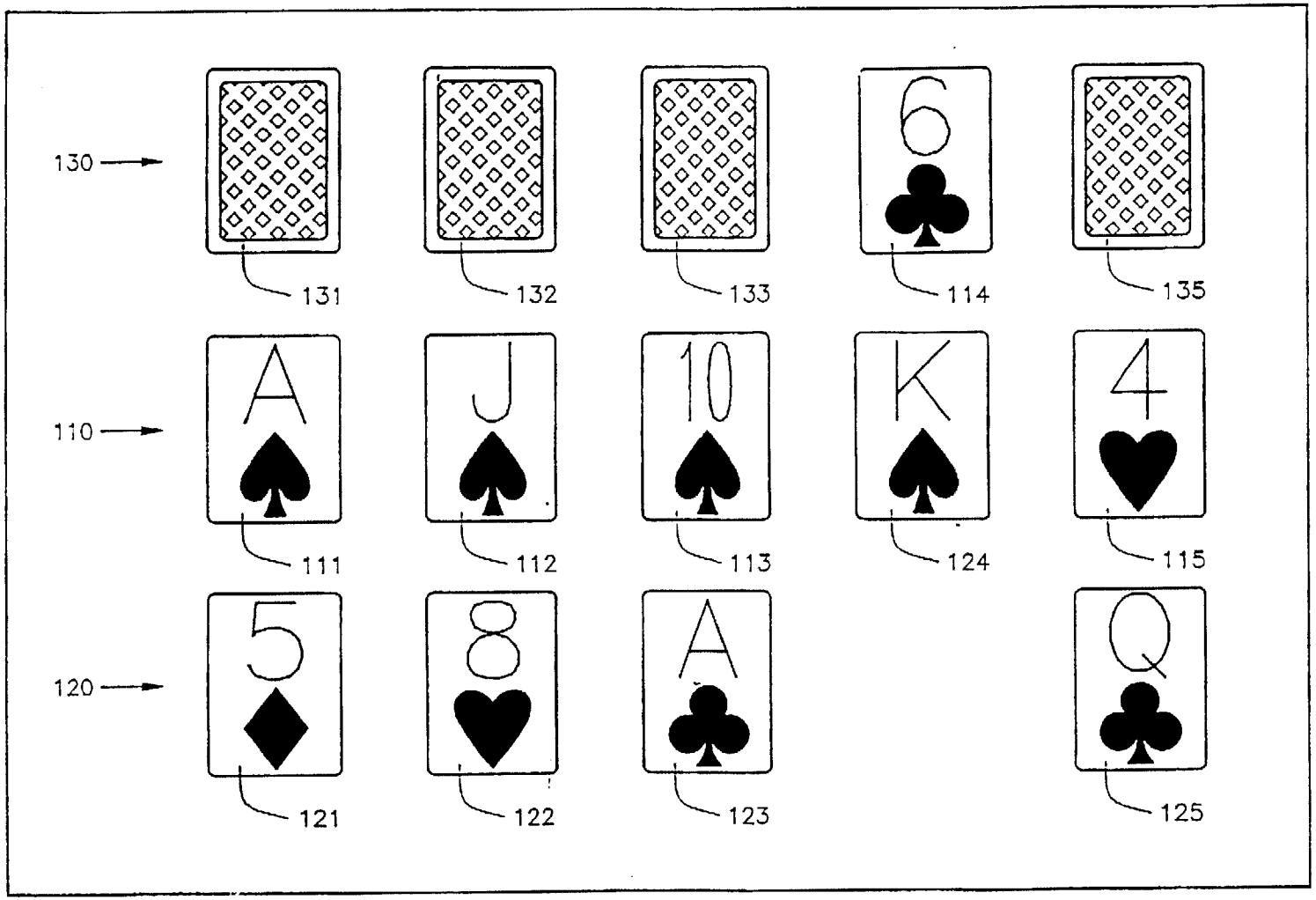
FIG. 5 shows the screen display for Version #2A after the player has selected a replacement card from the bottom row.

The object of the method of play is for the player to attempt to achieve a winning poker hand combination on the five cards in the center row draw hand 110. After the initial deal, the player can first determine whether he wishes to discard up to five cards in the center row 110 and replace the discarded cards, if any, with an exposed card from the bottom row 120. Only cards that are vertically aligned made be used as replacement cards for cards discarded from the center row 110. In the example shown in FIG. 5, the player would discard the Six of Clubs 114 from the center row 110 and replace this card with the corresponding vertically aligned card, the King of Spades 124 from the bottom row 120 in hopes of achieving a Royal Flush in the center row 110.

The player effects this discarding and replacement by manipulating buttons on the gaming device or be using touch screen technology to touch the card locations on the screen. In the preferred embodiment of the present invention, the King of Spades 124 is physically moved on the screen display to the center row 110 and the discarded card, the Six of Clubs 114, is physically moved to the top row 130 on the screen display.

After the player has determined whether to use any one or more of the face up cards from the bottom row 120 as replacement cards for center row 110 cards, the player determines if he wishes to use any one or more of the face down cards from the top row 130 as replacement cards for center row 110 cards. Again by either pressing buttons or using touch screen technology, the player selects which center row 110 cards are to be discarded and replaced by top row 130 cards. Again, only vertically aligned corresponding top row 130 cards can be selected as replacement cards for those cards to be discarded from the center row 110.

Figure 6:
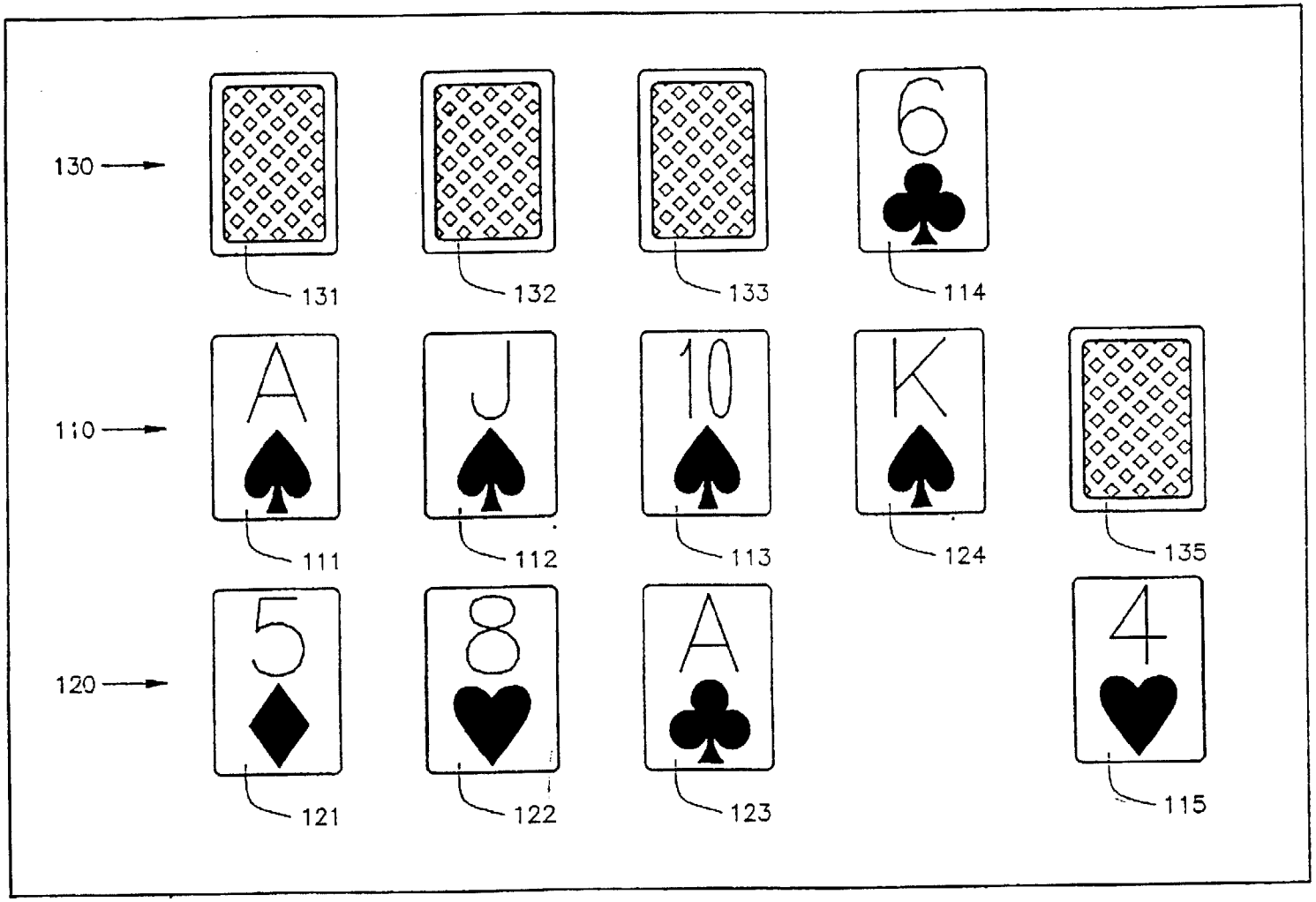
FIG. 6 shows the screen display for Version #2A after the player has received a replacement card from the top row.

FIG. 6 shows in the example that the player has determined to replace the Four of Hearts 115 from the center row 110 with the corresponding top row card 135. The Four of Hearts 115 is physically moved to the bottom row 120 and the top row card 135 is moved to the center row 110 to replace the Four of Hearts. The top row card may itself be replaced by a duplicate of itself or a new face down card. This would allow the player to make a separate bet on the face down stud hand in the top row. The play of the game would be similar to Version #1 except that any face up cards that were moved into the top row would be replaced by new cards when the player presses the "Deal" button.

When the player has completed replacing center row cards with either top or bottom cards and has selected his final five card arrangement for the center row 110, the player presses the "deal" button and all face down cards are turned face up. If the five cards in the center row 110 achieve a winning combination, the player is paid an amount based on the amount of his wager according to a pay table based on poker hand rankings.

In the example, if the face down card 135 when turned face up is the Queen of Spades, the center row 110 cards would achieve a Royal Flush and the player would be paid according to the pay table for a Royal Flush. If the player did not wish to risk trying to achieve a Royal Flush, the player could have taken a lesser payout by using the Queen of Clubs 125 from the bottom row 120 and achieve a simple Straight on the center row and receive the lesser payout from the pay table associated with a Straight.

Figure 7:
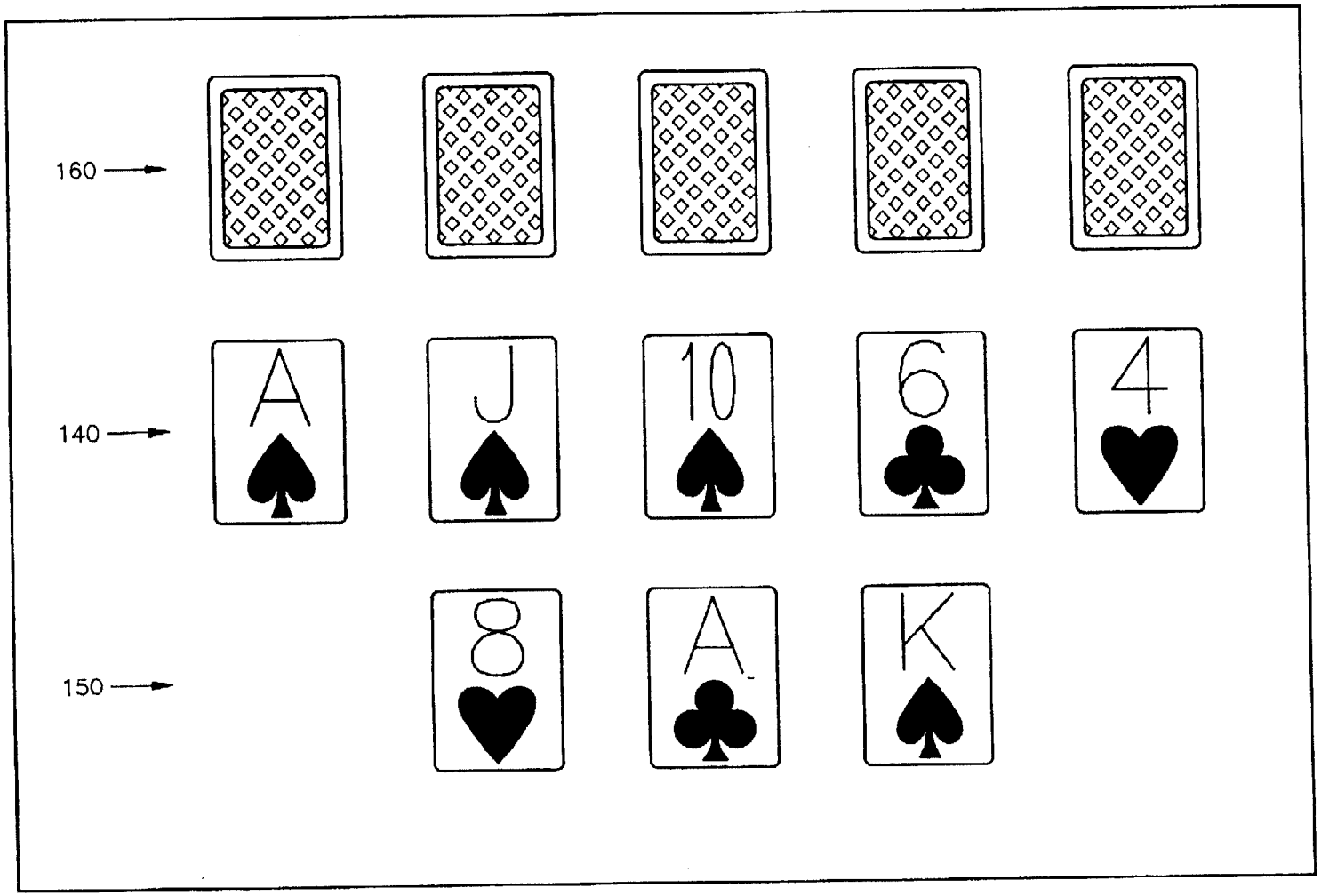
FIG. 7 shows the screen display for Version #2B after the initial deal of the cards.

Version #2B: This version plays the same as Version #2A. The center row 140 is dealt face up and the top row 160 is dealt face down. The two face up replacement cards at each end of the bottom row 150 are eliminated as shown in FIG. 7. Thus the player only has three face up replacement cards in the bottom row 150 and the player will have fewer options for replacement cards in this version.

Figure 8:
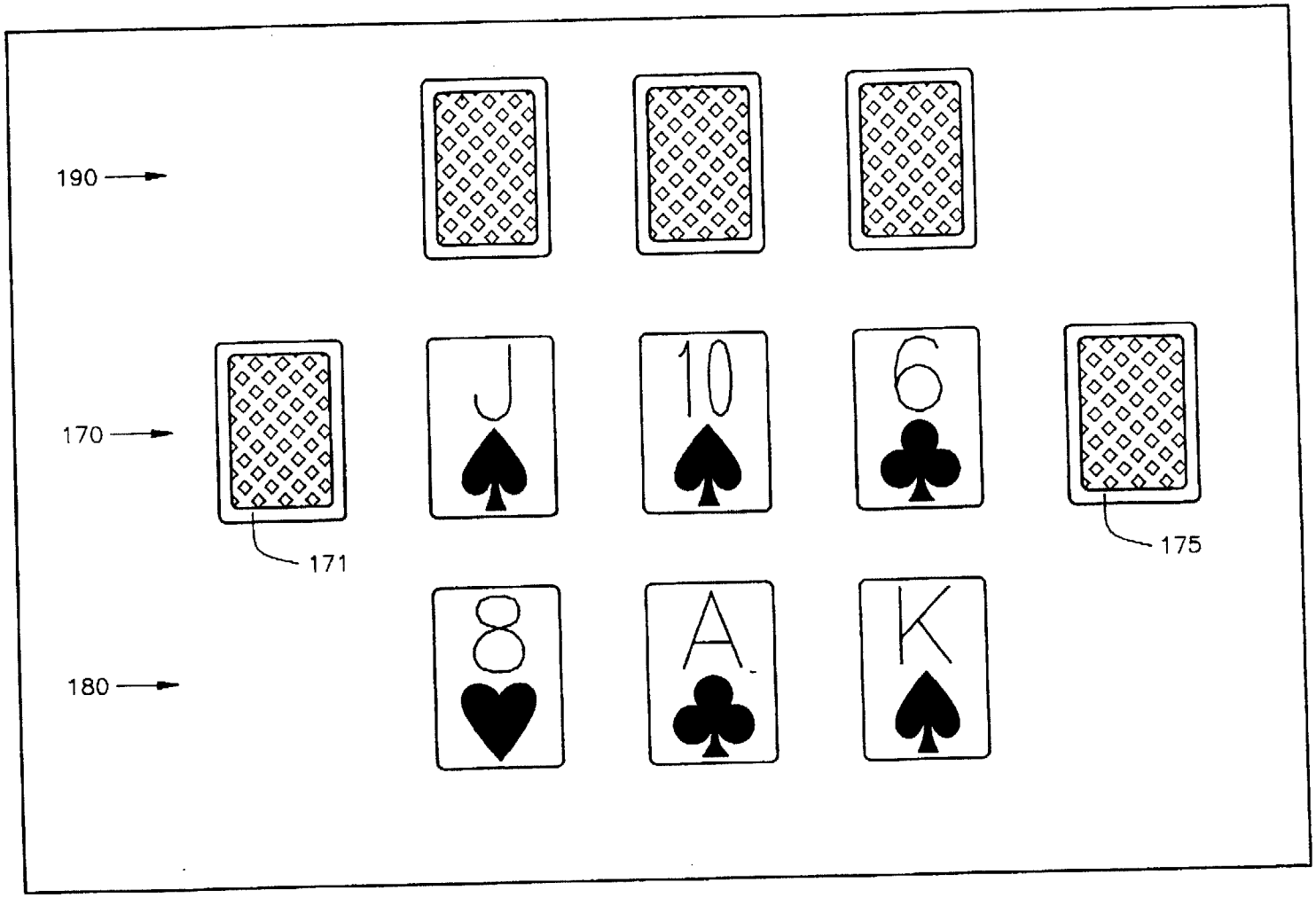
FIG. 8 shows the screen display for Version #2C after the initial deal of the cards.

Version #2C: Again, this version plays the same as Version #2A. As shown in FIG. 8, the center row 170 has its two end cards 171 and 175 dealt face down with the three remaining center row cards dealt face up. The top row 190 has only three cards all dealt face down and the bottom row 180 has only three cards all dealt face up. After the player has made his selections regarding replacement cards, the face down cards 171 and 175 in the center row 170 are then revealed. There are no replacement cards for the two end cards 171 and 175 of the center row 170.

Figure 9:
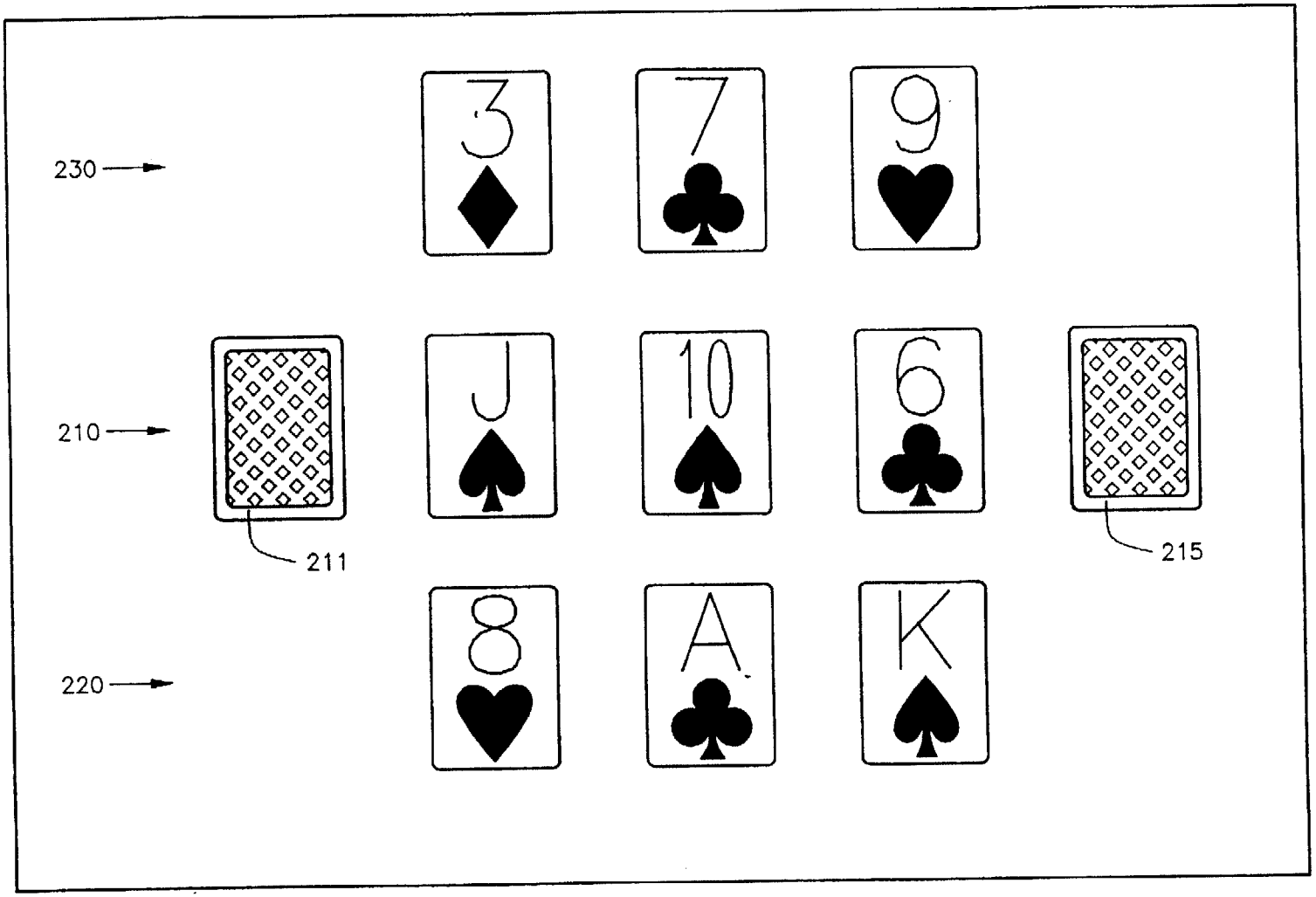
FIG. 9 shows the screen display for Version #2D after the initial deal of the cards.

Version #2D: This version plays the same as Version #2A. As shown in FIG. 9, the center row 210 has its two end cards 211 and 215 dealt face down. The bottom row 220 has only three cards, all dealt face up. The top row 230 also has only three cards, all dealt face up. After the player has chosen the replacement cards, the two face down end cards 171 and 175 are revealed. There are no replacement cards for the two ends cards 211 and 215 of the center row 210. This version gives the player full disclosure to select the best middle three hands, but the two end cards are left to chance.

Figure 10:
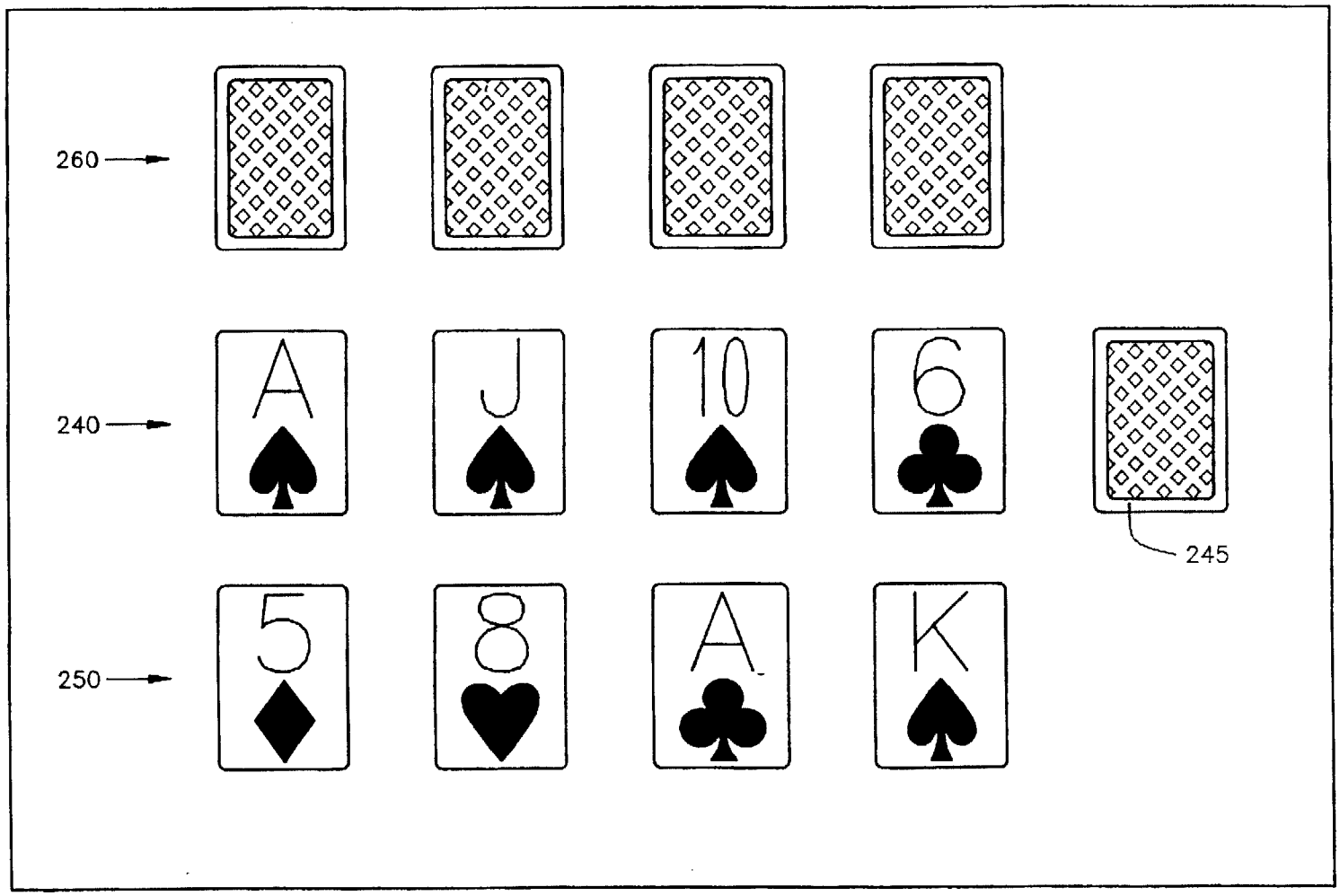
FIG. 10 shows the screen display for Version #2E after the initial deal of the cards.

Version #2E: This version again plays the same as Version #2A. The initial deal layout is shown in FIG. 10. The center row 240 has four face up cards and the fifth card 245 is dealt face down. The bottom row 250 has only four cards, all dealt face up and the top row 260 has only four cards, all dealt face down. There is no replacement card for the fifth center row card 245.

Figure 11:
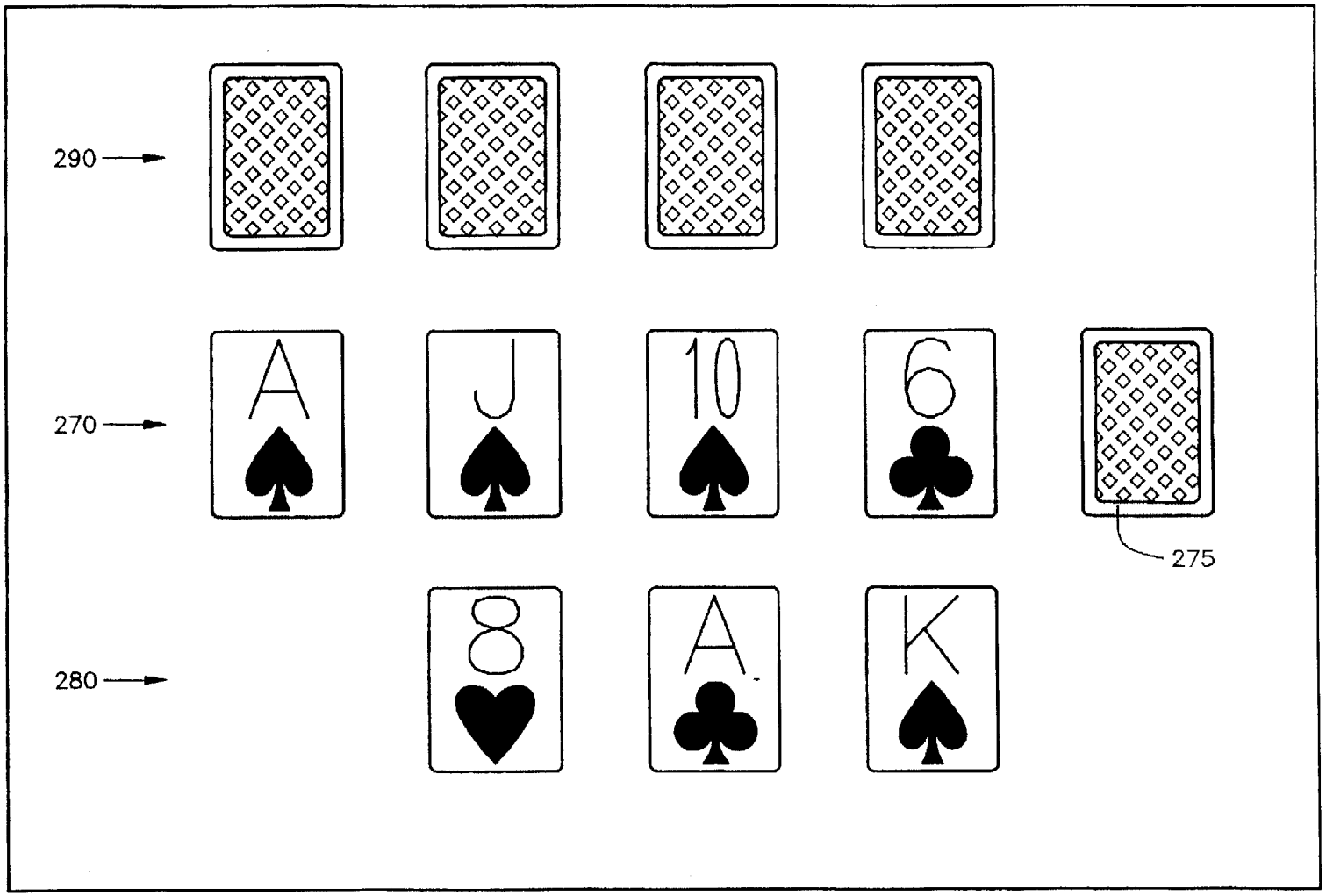
FIG. 11 shows the screen display for Version #2F after the initial deal of the cards.

Version #2F: This version also plays the same as Version #2A. The initial deal layout is shown in FIG. 11. The center row 270 has four face up cards and the fifth card 275 is dealt face down. The bottom row 280 has only three cards, all dealt face up and the top row 290 has only four cards, all dealt face down. There is no replacement card for the fifth center row card 275. This version gives the player less options for the replacement of cards.

Figure 12:
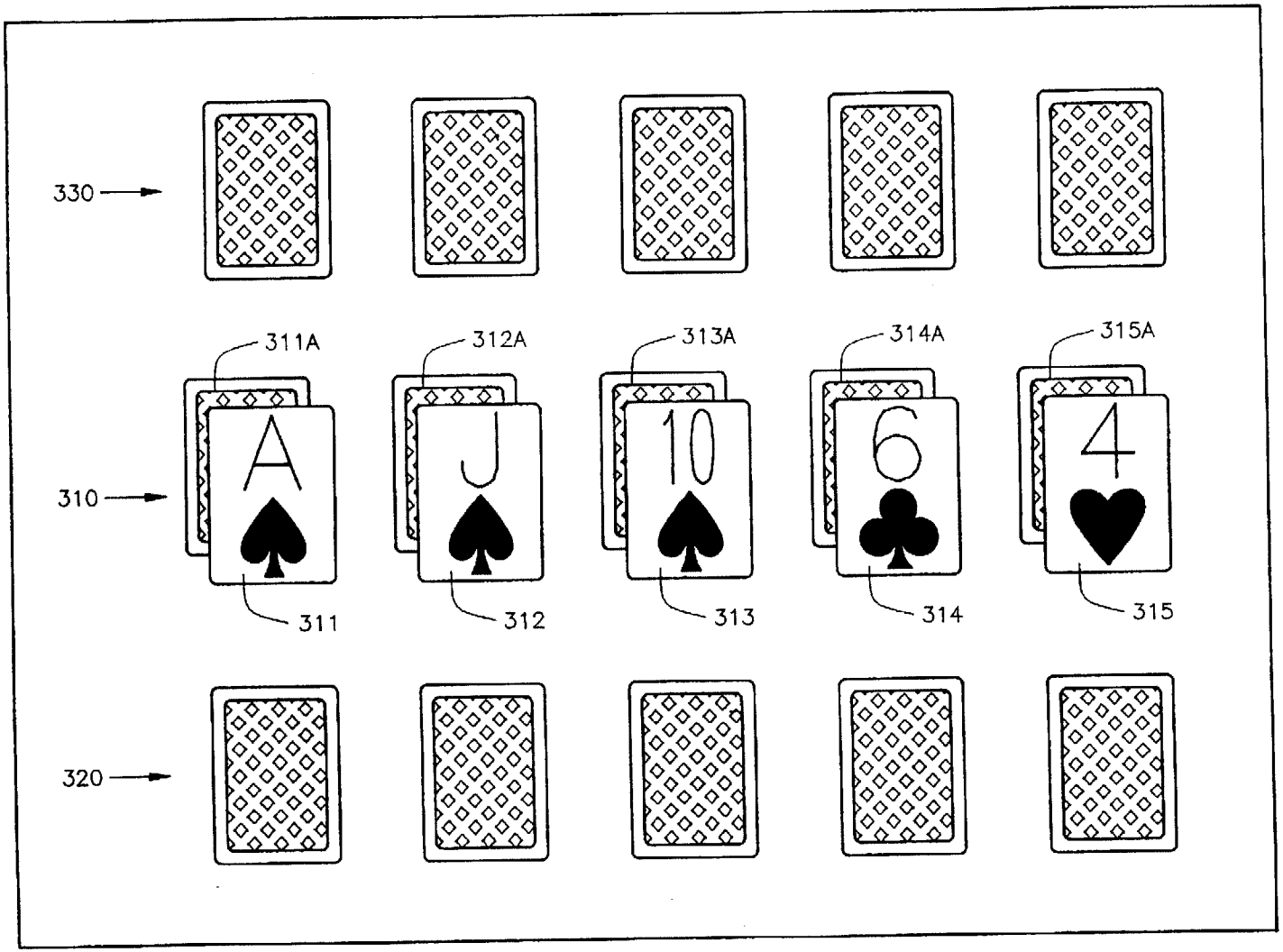
FIG. 12 shows the screen display for Version #2G after the initial deal of the cards.

Version #2G: This version is somewhat similar to Version #2A, but is more complicated. FIG. 12 shows the layout for the initial deal of this version. Three rows of cards are initially dealt. The center row 310 is dealt face up; the bottom row 320 and the top row 330 are dealt face down. Also, a face down card 311A, 312A, 313A, 314A and 315A is dealt underneath each of the respective face up cards 311, 312, 313, 314 and 315 in the center row 310.

The player makes one, two or three wagers: the first wager is on row 310, the second wager is on row 320 and the third wager is on row 330. Thus, the player is playing one, two or three hands at a time.

The player selects those cards in the center row 310 that he wishes to hold. The player effects this selection by pressing buttons or, using touch screen technology, by simply pressing the cards on the screen that the player wishes to hold. Each card that is held by the player from the center row 310 is duplicated in the corresponding vertically aligned position in both the bottom row 320 and the top row 330. Therefore, three copies of the held card are now displayed on the screen. The player may hold from zero to five cards from the center row 310.

Figure 13:
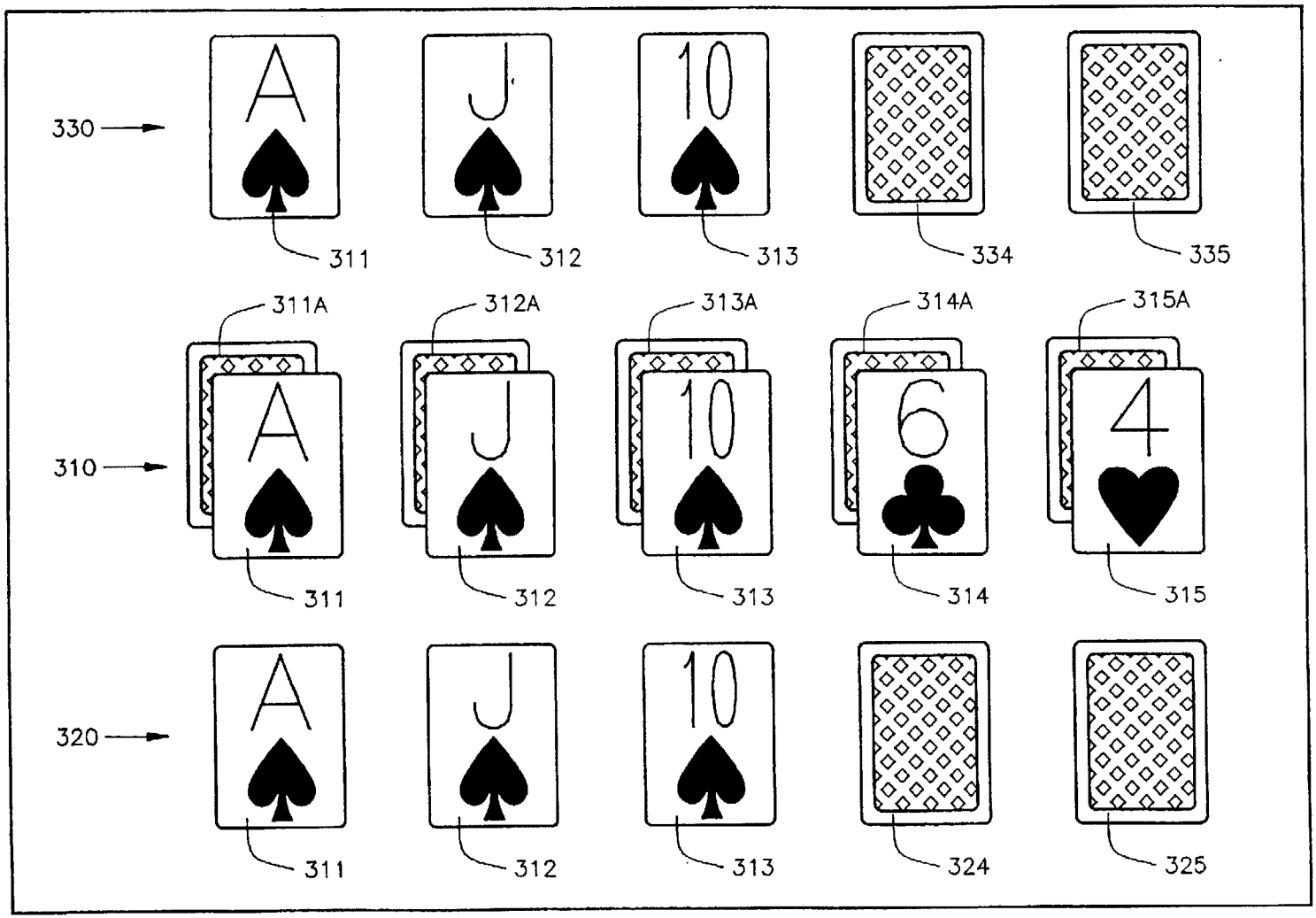
FIG. 13 shows the screen display for Version #2G after the player has selected the cards he wishes to hold from the center row.

FIG. 13 shows an example of the play of the hand when the player has held card 311, card 312 and card 313 from the center row 310. Card 311, the Ace of Spades, is duplicated in the same aligned position in top row 330 and in bottom row 320. Likewise, card 312, the Jack of Spades, and card 313, the Ten of Spades, are both duplicated in the same aligned positions in top row 330 and bottom row 320.

After the player is satisfied with his selection of replacement cards, the player presses the "deal" button and the two face down cards 324 and 325 in bottom row 320 are revealed. Similarly, the two face down cards 334 and 335 in top row 330 are revealed. The two unheld cards 314 and 315 in the center row 310 are replaced with the face down cards underneath them, cards 314A and 315A, and these two cards 314A and 315A are also revealed.

Each row is treated as a separate hand for payout purposes. Each row is evaluated for poker hand ranking and the player is paid based on the amount of his wager on each row depending on the poker hand ranking achieved for that row.

Thus, the player has effectively played three hands at once. The player could win on all three hands, could lose on all three hands, could win on two hands and lose on one hand or could lose on two hands and win on one hand.

In the preferred embodiment of this invention, the method of play uses a standard fifty-two card deck. One or more cards may also be designated as wild cards. If a player holds less than five cards from the center row, each hand will have different replacement cards so that player has the possibility of achieving various winning combinations. This game may also be dealt using three separate decks of cards—the first row being dealt using a first standard fifty two card deck while the second row is dealt using a second deck of forty-seven cards which comprises a standard fifty-two card deck having the player's five initial face up cards shown in the first row omitted therefrom and the third row is dealt using a third deck of forty-seven cards which comprises a standard fifty-two card deck having the player's five initial face up cards shown in the first row omitted therefrom. This would allow the player, for example, to theoretically make three Royal Flushes at the same time.

Special bonus payouts can be added if the player achieves three high ranking hands at the same time. These bonus payouts could be fixed amounts or progressive payouts. For example, the player could win a progressive payout for achieving three Full Houses at the same time.

Version #2H: This version is played similarly to Version #2G, except for a modification to the manner in which the cards are dealt to the display screen. In this version, five cards are dealt to the center row, all face up. The player selects which cards he wishes to hold and the held cards are duplicated in the vertically aligned position in both the top row and the bottom row. After the player is satisfied with his selection of held cards, the player presses the "deal" button and the remaining cards for each row are then dealt. Each row will receive different cards to complete five card hands.

Version #2I: In this version, fifteen cards are dealt and displayed on the screen. These fifteen cards are dealt in three rows of five cards each. The player then proceeds to play three separate five card hands—each row being a separate hand. The player selects which cards to hold and discard from each row. After the player has completed this selection, the player presses the "deal" button and replacement cards are dealt and displayed. Each row is then determined for poker hand ranking and the player wins according to the pay table based on the amount wagered for each row. The player has the advantage of seeing fifteen cards prior to holding and discarding, so the player knows which cards from the deck will not be available as replacement cards on the draw.

One modification to these versions involves the addition of bonus round which the player earns based on achieving certain hand combinations. If the player qualifies for a bonus round, the player is dealt five cards at random from the deck. Each card is initially displayed on the video screen face down and are turned over one at a time. The player is paid if this bonus hand qualifies for the bonus award pay table. A jackpot, which is either fixed amount of a progressive jackpot, can be paid for a Royal Flush or even a sequential Royal Flush.

Alternatively, the bonus round may be dealt at the end of or during every round of the game giving the player a chance to win the bonus payout each round of the game. Further, the bonus round may require the player to make an additional wager to participate.

Other modifications may be made to the method of play of these versions which differ only in the number of rows of cards. These versions can be played using two, four or five rows on five cards each. An example of one of these modifications would be Version #2J.

Version #2J. This version is played similar to Version #2G except that there are two additional rows of face down cards, one being a top row and the other being the bottom row. Thus, there are a total of five rows of cards with only the center row being face up on the initial deal. As in Version #2G, the center row also has an underlying row of face down cards on the initial deal.

The play of this version is essentially the same as Version #2G except that the player is now effectively playing five hands of video poker at the same time instead of only three hands at a time as in Version #2G. Each card that the player selects to be held is duplicated into the two face down rows directly below the held card as well as the two face down rows directly above the held card.

The method of play of this Version #2J also creates additional five card stud hands of replacement cards in each of the vertical columns. Special payouts or progressive or non-progressive jackpots may be awarded for high ranking stud hands that may be formed in these vertical columns such as a Full House, a Royal Flush or even a sequential Royal Flush.

The concept of the present invention may also be extended to other known casino games such as CARIBBEAN STUD® poker, LET IT RIDE® or Texas Hold 'Em. Each of these known casino games could be modified by the addition of another wager which allows the player to bet on the outcome of the dealer's hand.

For example, in CARIBBEAN STUD® poker, a player would be allowed to make an additional wager on the composition of the dealer's five card stud hand. The payouts on this additional wager would be made in accordance with a separate pay table which would allow all players the opportunity to win at the same time for certain high ranking hands achieved by the dealer. In effect this would act as a type of insurance bet for those situations in which the player achieves a high ranking hand but is beaten by the dealer's hand.

In the case of LET IT RIDE®, a bonus hand for the dealer would be created by dealing three extra face down cards on the table layout adjacent to the two common cards used in this game. In addition to making the normal wager on his own hand, the player would also have the option of making a separate wager on the composition of these three extra cards along with the two common cards. This separate wager would pay in accordance with a separate pay table and would allow all players the opportunity to win at the same time. This separate wager could also feature special progressive or non-progressive jackpot awards for a Royal Flush or a sequential Royal Flush achieved by this bonus hand.

As applied to Texas Hold 'Em, the player would make a separate wager on the poker hand value of the five community cards themselves. This could be played either with or without an additional progressive or non-progressive jackpot that would pay for a Royal Flush or a sequential Royal Flush. In those situations where more than one player at the table has made this separate wager and a winning hand occurs, any payouts would be shared by those players matting the separate wager in proportion to the amount of their separate wagers.

An example of a pay table that can be used for the separate wagers described in the last three situations would be as follows as shown in Table 1.:

TABLE 1

| | |
|---|---|
| Pair of 6's or Better | 1 to 1 |
| Two Pair | 2 to 1 |
| Three of a Kind | 3 to 1 |
| Straight | 10 to 1 |
| Flush | 20 to 1 |
| Full House | 30 to 1 |
| Four of a Kind | 100 to 1 |
| Straight Flush | 800 to 1 |
| Royal Flush | Progressive jackpot |

Other payout tables could be used depending on the winning hand combinations that are designated and the hold percentage desired.

Combined Twenty-One Game and Stud Poker Game

Another variation of the present invention involves combining the play of a conventional Twenty-One game with a Stud Poker game. In order to play this combined game, a player makes two wagers—a first wager to participate in the conventional Twenty-One game and a second wager to participate in the Stud Poker game.

Version A

After the two initial wagers are made, the dealer deals two cards to the player and two cards to the dealer. The conventional Twenty-One game is conducted with the player and dealer taking hits or standing according to the conventional manner of play of Twenty-One. After the play of the player's hand and the dealer's hand is complete, the dealer pays all winning player hands and collects all losing player hands.

The Stud Poker game is then conducted. The player's hand is discarded and only the cards from the dealer's hand are used. If the dealer has five cards after the play of his hand during the conventional Twenty-One game, these five cards are used and evaluated as to the combination that these five cards create using conventional poker hand rankings.

If the dealer has less than five cards after the play of his hand during the conventional manner of play of the Twenty-One game, then additional cards are dealt to the dealer from the deck of cards that was used in the Twenty-One game to fill out a five card hand for the dealer. If the dealer had more than five cards after the play of his hand during the conventional manner of play of the Twenty-One game, then only the first five cards are used.

The player is paid on his second wager for the Stud Poker game based on a payout schedule similar to the payout schedules used in video poker.

Version B

This version of the invention is similar to Version A except that the cards from the player's hand are not discarded but are used to form a Stud Poker hand.

After the player makes the two initial wagers to be eligible for both the Twenty-One game and the Stud Poker game, the dealer deals two cards to the player and two cards to the dealer. The conventional Twenty-One game is conducted with the player and dealer taking hits or standing according to the conventional manner of play of Twenty-One. After the play of the player's hand and the dealer's hand is complete, the dealer pays all winning player hands and collects all losing player hands.

The Stud Poker game is then conducted. The player's hand is used to create a five card Stud Poker hand. If the player has five cards after the play of his hand during the conventional Twenty-One game, these five cards are used and evaluated as to the combination that these five cards create using conventional poker hand rankings.

If the player has less than five cards after the play of his hand during the conventional manner of play of the Twenty-One game, then additional cards are provided to the player from the dealer's hand to fill out a five card hand for the player. For example, if the player had a two card hand, then the first three of the dealer's cards would be combined with the player's cards to create a five card hand. If the player had a three card hand, then the first two of the dealer's cards would be combined with the player's cards to create a five card hand.

If the combination of the player's hand and the dealer's hand total less than five cards, then additional cards are dealt to the dealer's hand from the deck of cards that was used in the Twenty-One game so that the dealer's hand will have enough cards to fill out a five card hand for the player.

As an alternate method to complete the player's five card hand, if the player has less than five cards after the play of his hand during the conventional manner of play of the Twenty-One game, then additional cards are dealt to the player from the deck of cards that was used in the Twenty-One game to fill out a five card hand for the player. If the player had more than five cards after the play of his hand during the conventional manner of play of the Twenty-One game, then only the first five cards are used.

The player is paid on his second wager for the Stud Poker game based on a payout schedule similar to the payout schedules used in video poker. A representative payout table, based on dealing cards from a shoe of six decks is shown in Table 2.:

TABLE 2

| | |
|---|---|
| Royal Flush | 1000 to 1 |
| Five of a Kind | 500 to 1 |
| Straight Flush | 200 to 1 |
| Four of a Kind | 25 to 1 |
| Full House | 11 to 1 |
| Flush | 8 to 1 |
| Straight | 6 to 1 |
| Three of a Kind | 2 to 1 |
| Two Pair | 3 to 2 |
| Pair of Sevens or Better | 1 to 1 |
| Lesser Hands | Loss |

The method of this version of the present invention can be dealt using any number of decks of cards, but the preferred embodiment is to utilize a dealing shoe containing six standard decks of fifty-two playing cards shuffled together.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising a combination to conventional Twenty-One and Stud Poker comprising:

a) a player making a first wager to be eligible for a Twenty-One portion of the game;

b) a player making a second wager to be eligible for a Stud Poker portion of the game;

c) dealing two cards to the player;

d) dealing two cards to a dealer;

e) the player and the dealer continuing the play of the Twenty-One portion of the game according to the conventional manner of play of Twenty-One;

f) paying the player based on the amount of the first wager if the player achieves a winning hand during the Twenty-One portion of the game;

g) at the completion of the Twenty-One portion of the game, conducting a Stud Poker game using the cards dealt during the Twenty-One portion of the game to form a Stud Poker hand;

h) paying the player based on the amount of the second wager if the player achieves a winning Stud Poker hand during the Stud Poker portion of the game.

2. The method of claim 1 in which the player is paid a preestablished amount based on the second wager if the Stud Poker hand comprises a predetermined poker hand ranking.

3. The method of claim 2 in which the preestablished amount and the predetermined poker hand rankings are set out in a pay table.

4. The method of claim 3 in which the pay table comprises:

| | |
|---|---|
| Royal Flush | 1000 to 1 |
| Five of a Kind | 500 to 1 |
| Straight Flush | 200 to 1 |
| Four of a Kind | 25 to 1 |
| Full House | 11 to 1 |
| Flush | 8 to 1 |
| Straight | 6 to 1 |
| Three of a Kind | 2 to 1 |
| Two Pair | 3 to 2 |
| Pair of Sevens or Better | 1 to 1 |
| Lesser Hands | Loss |

5. The method of claim 1 in which the cards used during the Stud Poker portion of the game comprise the dealer's hand:

a) if the dealer's hand comprises of five cards, using the five cards of the dealer's hand;

b) if the dealer's hand comprises more than five cards, using the first five cards of the dealer's hand;

c) if the dealer's hand comprises less than five cards, dealing additional cards to the dealer's hand to complete a five card hand.

6. The method of claim 1 in which the cards used during the Stud Poker portion of the game comprise the player's hand:

a) if the player's hand comprises of five cards, using the five cards of the player's hand;

b) if the player's hand comprises more than five cards, using the first five cards of the player's hand;

c) if the player's hand comprises less than five cards, adding additional cards to the player's hand from the dealer's hand to complete a five card hand;

d) if the player's hand and dealer's hand combined comprise less than five cards, dealing additional cards to the player's hand to complete a five card hand.

7. The method of claim 1 in which the card used during the Stud Poker portion of the game comprise:

a) if the player's hand comprises of five cards, using the five cards of the player's hand;

b) if the player's hand comprises more than five cards, using the first five cards of the player's hand;

c) if the player's hand comprises less than five cards, dealing additional cards to the player's hand to complete a five card hand.

* * * * *